US006059850A

United States Patent [19]

Lise et al.

[11] Patent Number: 6,059,850

[45] Date of Patent: May 9, 2000

[54] RESILIENT ABRASIVE ARTICLE WITH HARD ANTI-LOADING SIZE COATING

[75] Inventors: Jonathan M. Lise, Woodbury; Chris A. Minick, Stillwater, both of Minn.

[73] Assignee: 3M Innovative Properties Company, St. Paul, Minn.

[21] Appl. No.: 09/116,038

[22] Filed: Jul. 15, 1998

[51] Int. Cl.[7] ..... B24D 3/00; B24D 3/34; B24D 3/28; B24D 11/00

[52] U.S. Cl. ..... 51/297; 51/295; 51/296; 51/298; 51/299; 51/309

[58] Field of Search ..... 51/295, 296, 297, 51/298, 299, 309

[56] References Cited

U.S. PATENT DOCUMENTS

| | | | |
|---|---|---|---|
| 3,773,480 | 11/1973 | Hall et al. . | |
| 4,263,755 | 4/1981 | Globus . | |
| 4,569,861 | 2/1986 | Smith et al. . | |
| 4,613,345 | 9/1986 | Thicke et al. . | |
| 4,629,473 | 12/1986 | Ruid et al. . | |
| 4,652,274 | 3/1987 | Boettcher et al. . | |
| 4,714,644 | 12/1987 | Rich . | |
| 4,903,440 | 2/1990 | Larson et al. . | |
| 4,966,609 | 10/1990 | Callinan et al. . | |
| 4,966,699 | 10/1990 | Sasaki et al. . | |
| 5,236,472 | 8/1993 | Kirk et al. . | |
| 5,242,749 | 9/1993 | Bayly et al. . | |
| 5,378,252 | 1/1995 | Follensbee . | |
| 5,429,545 | 7/1995 | Meyer . | |
| 5,595,578 | 1/1997 | Stubbs et al. . | |
| 5,609,513 | 3/1997 | Stark . | |
| 5,656,011 | 10/1996 | Follett et al. | 51/298 |

FOREIGN PATENT DOCUMENTS

| | | |
|---|---|---|
| 0 237 784 A1 | 9/1987 | European Pat. Off. . |
| 0 400 658 A2 | 12/1990 | European Pat. Off. . |
| 0 414 346 A1 | 2/1991 | European Pat. Off. . |
| 0 638 392 A1 | 2/1995 | European Pat. Off. . |
| 0 740 980 A2 | 11/1996 | European Pat. Off. . |
| 12 71 588 | 6/1968 | Germany . |
| 2 326 361 | 12/1998 | United Kingdom . |
| WO 92/01536 | 2/1992 | WIPO . |
| WO 97/31079 | 8/1997 | WIPO . |

OTHER PUBLICATIONS

U.S. Pat. application Ser. No. 08/968,393 filed Nov. 12, 1997 in the names of Kris A. Beardsley, et al. entitled "Abrasive Foam Article and Method of Making Same."

*Primary Examiner*—Michael Marcheschi
*Attorney, Agent, or Firm*—David B. Patchett

[57] ABSTRACT

A resilient abrasive article includes a resilient elongatable substrate, abrasive particles adhesively bonded to the substrate with a flexible make coat, and a hard size coat applied over the abrasive particles and flexible make coat. The size coat provides an anti-loading layer which is applied thinly enough to prevent the size coat from cracking and tearing the substrate during use.

15 Claims, 3 Drawing Sheets

RESILIENT ABRASIVE ARTICLE WITH HARD ANTI-LOADING SIZE COATING

FIELD OF THE INVENTION

The present invention relates generally to resilient articles, such as sanding sponges. More particularly, the present invention relates to an abrasive article having a flexible make coating and a thin, hard, anti-loading size coating.

BACKGROUND OF THE INVENTION

Coated abrasive articles are normally prepared by coating at least one surface of a substrate with a first adhesive binder layer, often referred to as the "make" coating. Particles of abrasive material are applied to the coated substrate and partially embedded therein. A layer of a second binder, often referred to as the "size" coating, is then applied over the abrasive particles and make coating. Typical abrasive coatings generally include a make coating, abrasive particles, and a size coating. Anti-loading materials have also been included in a further optional layer, referred to as a "supersize" coating, which prevents buildup on the abrasive surface and, therefore, increases the useful life of the article.

Resilient or conformable abrasive articles, such as sanding sponges, are known in the prior art. Such abrasive articles have been found useful in cleaning, polishing, abrading, and dimensioning materials such as wood, metal, plastic, and the like, especially when such materials have and are to retain irregular, relieved, or otherwise intricate surface contours, or, when the manual control of working pressures between the abrasive article and the workpiece is desirable, such as when smoothing interior drywall surfaces.

To maintain the resilient properties of the abrasive article, flexible elastomeric binders are often used to adhesively bond the abrasive particles to a major surface of the foam substrate. In addition to using elastomeric binders, most conventional resilient abrasive articles are constructed so that each coating layer is at least as flexible as the underlying coating layer. Thus, for a typical resilient abrasive article having a make coat applied to a resilient foam substrate, abrasive particles embedded in the make coat, and a size coat applied over the make coat and abrasive particles, the size coat would be at least as flexible as the make coat. Such a configuration allows the abrasive article to maintain its flexibility and prevents the abrasive coating from cracking or splitting as the abrasive article is run over sharp corners or edges of a work surface during use. Flexible make and size coats, however, are soft and therefore do not provide adequate lateral support for the abrasive particles. As a result, the particles tend to tilt relative to the foam substrate as the abrasive article is pressed and moved along the work surface, thereby greatly reducing the effectiveness of the abrasive article. In addition, the soft size coat tends to rapidly buildup with swarf which shortens the useful life of the abrasive article.

Hard or rigid size coats are desirable because they provide lateral support for the abrasive particles which increases cut, and because they reduce buildup which increases the life of the article. However, when hard, non-elastomeric binders such as phenol-formaldehyde condensates are coated onto foam substrates, the resilient qualities of the foam substrates are quickly overcome by the physical properties of these binders, rendering the resultant abrasive article brittle and susceptible to cracking, tearing, and puncturing under normal use. The cracking and tearing of the abrasive article produces an inconsistent finish on the work surface and leads to premature failure of the abrasive article. To avoid the problems associated with hard size coats, most commercially available resilient abrasive articles either have been formed without a size coat or have been formed with a size coat that is at least as flexible as the make coat.

The Ruid et al. U.S. Pat. No. 4,629,473 discloses a resilient abrasive polishing product including a primary backing, a resilient layer laminated to the primary backing, and abrasive particles embedded in an elastomeric make coat on the side of the resilient layer opposite the primary backing. The product can also include an intermediate coating between the resilient layer and the elastomeric make coat, and a phenolic resin sizing adhesive layer. The primary backing can be formed of a finished cloth, paper, vulcanized fiber, non-woven webs, or plastic film. These materials are relatively inelastic and therefore prevent the resilient layer, elastomeric make coat, and size coat from stretching or elongating. This, in turn, prevents the size coat from cracking and resilient layer from tearing. The backing, however, significantly adds to the overall cost of the product. In addition, the resilient layer is formed of a thin reticulated foam layer having a thickness of 1.44 to 2.41 millimeters. Having a thin resilient layer further adds to the inflexibility of the product and makes it unsuitable for many finishing applications.

It would therefore be desirable to provide a resilient abrasive article having a resilient elongatable foam substrate thick enough to conform to a contoured surface, abrasive particles adhesively bonded to the substrate with a flexible make coat, and a hard, relatively inflexible, size coat applied over the abrasive particles and flexible make coat. More specifically, it would be desirable to provide a resilient abrasive article having a hard size coat to provide lateral support for the abrasive particles and resist swarf buildup, but which does not suffer from the cracking problem associated with conventional resilient abrasive articles having a hard size coat. It would also be desirable to provide such a resilient abrasive article which does not require an inelastic backing to prevent such cracking.

SUMMARY OF THE INVENTION

In describing the present invention, "resilient" refers to a property of a material that enables it to substantially recover its original shape after being bent, twisted, stretched, or compressed. "Resilient abrasive article" refers to an abrasive article that does not result in knife-edging of the abrasive coating when the abrasive article is folded onto itself with the abrasive surface out. Knife-edging occurs when the abrasive coating cracks and de-laminates from the foam substrate, thereby producing sharp knife-like edges that can scratch the work surface. "Make coat precursor" refers to the coatable resinous adhesive material applied to the coatable surfaces of the open cells of the foam substrate to secure abrasive particles thereto. "Make coat" refers to the layer of hardened resin over the coatable surfaces of the open cells of the foam substrate formed by hardening the make coat precursor.

"Size coat precursor" refers to the coatable resinous adhesive material applied to the coatable surfaces of the open cells of the foam substrate over the make coat. "Size coat" refers to the layer of hardened resin over the make coat formed by hardening the size coat precursor.

In referring to the binder compositions of the make and size coats, "labile" means a foamed or frothed condition imparted to a liquid dispersion of binder material (e.g., a make coat precursor or a size coat precursor) so that the frothed state of the binder dispersion is transitory. By the term "froth", it is meant a dispersion of gas bubbles throughout a liquid where each bubble is enclosed within a thin film of the liquid. The labile foams utilized in the invention thus also encompass unstable foam consisting of relatively large bubbles of gas.

Swarf refers to the fine particles that are created during the abrading process. Anti-loading refers to the ability of a coating to resist the accumulation of swarf.

The present invention provides a resilient abrasive article including a resilient, conformable, elongatable substrate having an outer surface, a flexible make coat applied to at least a portion of the outer surface of the substrate, abrasive particles embedded at least partially within the make coat, thereby adhesively bonding the abrasive particles to the substrate, and a hard size coat covering the abrasive particles and flexible make coat. To minimize the likelihood of tearing the foam substrate, the hard size coat is formed as a very thin layer having a dry add-on weight of less than approximately 15 grains/24 $in^2$ (63 grams/$m^2$).

The abrasive article can further include a flexible barrier coat adjacent the substrate. Alternatively, the abrasive article can include abrasive particles adhesively bonded to the substrate with a flexible adhesive make coat, a flexible size coat applied over the abrasive particles and make coat, and a hard super-size coat applied over the flexible size coat. Another embodiment can include a flexible make coat applied to the foam substrate, abrasive particles embedded in a hard size coat applied over the flexible make coat, and a flexible super-size coat applied over the hard size coat and abrasive particles.

Suitable materials for forming the substrate include polyurethane foam, foam rubber, silicone, and natural sponge. Suitable material for forming the make coat or flexible size coat include nitrile rubber, acrylic, epoxy, urethane, polyvinyl chloride, and butadiene rubber. The abrasive particles can be aluminum oxide, silicon carbide, alumina zirconia, diamond, ceria, cubic boron nitride, garnet, ground glass, quartz, and combinations thereof. Suitable material for forming the hard size coat include phenolic resins, aiminoplast resins having pendant $\alpha,\beta$-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof.

The make coat precursor can be applied to the foam substrate using known coating techniques including knife coating, die coating, liquid roll coating, or spraying. The size coat can be formed by frothing the size coat precursor and applying the frothed size coat precursor to the make coat, or the size coat precursor can be sprayed directly onto the make coat.

BRIEF DESCRIPTION OF THE DRAWING

The present invention will be further described with reference to the accompanying drawings, in which.

DETAILED DESCRIPTION

Figure 1:
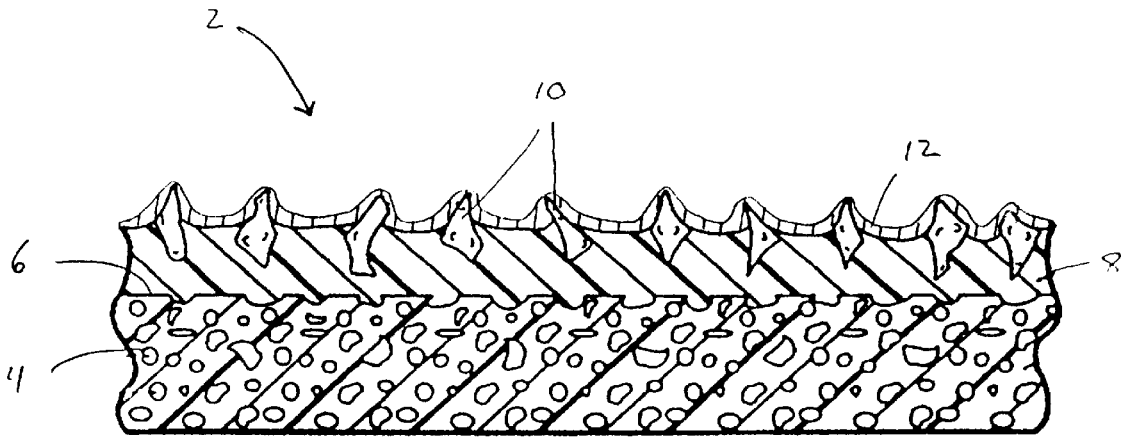
FIG. 1 is an enlarged cross-sectional view of an abrasive article according to the present invention.

Referring now to FIG. 1, there is shown a resilient abrasive article 2 including a resilient, conformable, elongatable substrate 4 having a first major surface 6 coated with a flexible make coat 8, a plurality of abrasive particles 10 at least partially embedded within the make coat 8, and a thin hard size coat 12 applied over the make coat 8 and abrasive particles 10. While the abrasive article is shown as having one major surface coated with abrasive, any or all surfaces of the substrate can be coated. The substrate 4, make coat 8, particles 10, and size coat 12 are each described in detail below.

Figure 2:
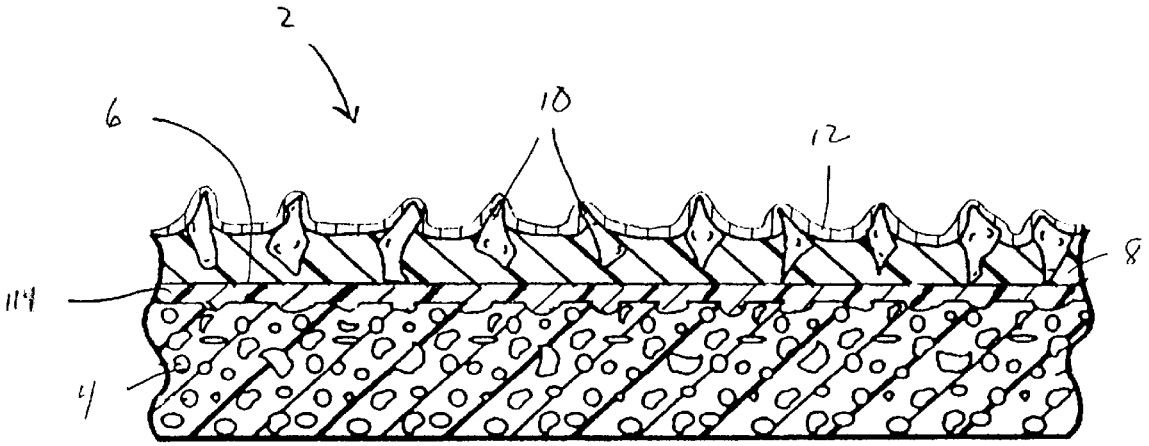
FIG. 2 is an enlarged cross-sectional view of a second embodiment of the invention.

FIG. 2 shows a resilient abrasive article similar to the article of FIG. 1 except the article of FIG. 2 further includes an intermediate barrier layer 114 between the substrate 4 and the make coat 8. Features in FIGS. 2 and 3 that are similar to those of FIG. 1 are identified with like reference numerals. The barrier layer 114 provides a smooth surface to which the make coat 8 can be applied. The barrier layer 114 can be formed from the same materials as the make coat 8, described in detail below.

Figure 3:
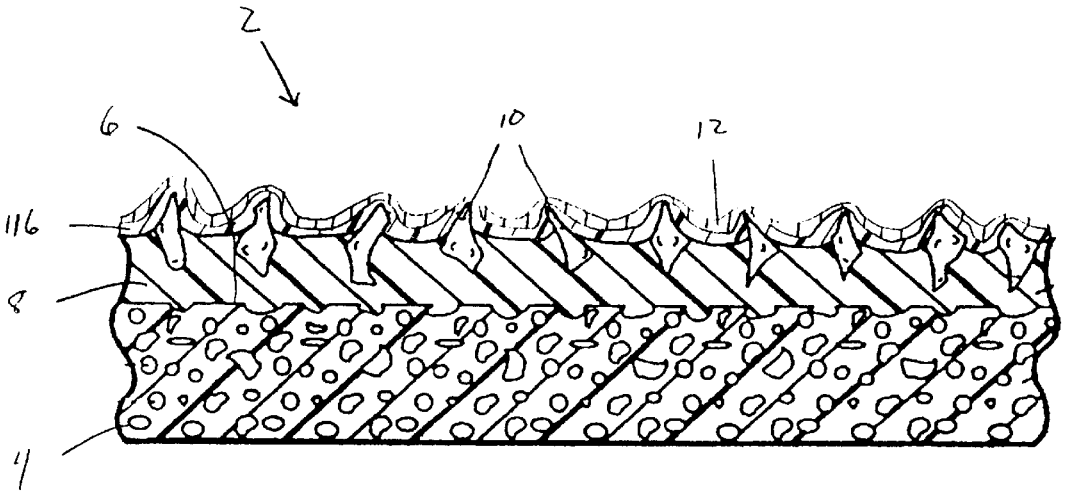
FIG. 3 is an enlarged cross-sectional view of a third embodiment of the invention.

FIG. 3 shows another resilient abrasive article similar to the article of FIG. 1 except the article of FIG. 3 further includes a first flexible size coat 116 between the make coat 8 and the hard size coat 12 which is now referred to as a "super size" coat. Such an article can be easily formed by simply applying a hard super size coat to a conventional resilient abrasive sponge which typically includes a resilient foam substrate, abrasive particles adhesively bonded to the substrate with a flexible make coat, and a flexible size coat. The presence of the flexible size coat 116 does not interfere with the improved performance achieved by adding the hard super size coat 12. The flexible size coat 116 can be formed from the same materials as the make coat 8, described in detail below.

It will be recognized that abrasive articles having other configurations can also be used. For example, the abrasive article can include a flexible make coat, a thin hard size coat, and a flexible super-size coat. In addition, the abrasive articles described above can be constructed to include additional coating layers.

Substrate

In general, any resilient substrate with coatable surfaces on at least one surface of the substrate may be used in the abrasive articles of the invention. These include open-cell foam, closed-cell foam, and reticulated foam, each of which can further include an outer skin layer. Suitable foam substrates can be made from synthetic polymer materials, such as, polyurethanes, foam rubbers, and silicones, and natural sponge materials. Such foam substrates have an elongation ranging from 50–300% (i.e. the stretched length of the foam minus the unstretched length of the foam all divided by the unstretched length of the foam and then multiplied by 100 equals 50–300%). A specific embodiment of the invention includes a foam substrate formed of urethane sponge having an elongation of approximately 90%. The thickness of the foam substrate is only limited by the desired end use of the abrasive article. Preferred foam substrates have a thickness in the range of about 1 mm to about 50 mm, although substrates having a greater thickness can also be used.

Make Coat The flexible make coat is formed by applying a make coat precursor to the substrate. Suitable make coat precursors include nitrite rubber, acrylics, epoxies, urethanes, polyvinyl chlorides, and butadiene rubbers. The make coat precursor is applied to the substrate at a coating weight which, when cured, provides the necessary adhesion to securely bond the abrasive particles to the foam substrate. For typical make coats, the dry add-on weight will range from 15–50 grains/24 $in^2$ (63–210 grams/$in^2$). The fully cured make coat has an elongation greater than the elongation of the foam substrate and will typically range from 50–800%.

Size Coat

In accordance with a characterizing feature of the invention, the size coat is formed by applying a thin layer of a size coat precursor over the make coat and abrasive particles, thereby to form a thin hard size coat having a dry add-on weight of less than approximately 15 grains/24 $in^2$ (63 grams/$m^2$). A more specific thin hard size coat has a dry add-on weight of 2–3 grains/24 $in^2$ (8.4–12.6 grains/$m^2$). Surprisingly, it has been found that when such a thin hard size coat is applied to an elongatable foam substrate, the thin hard size coat has a reduced tendency to tear the foam substrate when flexed, but maintains the improved performance characteristics associated with a thick hard size coat, namely increased life, cut, and wear resistance. A thin hard size coat therefore provides the same degree of lateral support for the abrasive particles as a thick size coat, which results in increased cut, and minimizes loading and buildup on the abrasive surface, which increases the life of the article. Perhaps more unexpectedly, however, is the fact that the thin hard size coat achieves these benefits while also reducing the likelihood that the elongatable foam substrate will tear when flexed. This reduced tendency of the elongatable foam substrate to tear is believed to be due to the fact that a thin size coat results in numerous micro-cracks which form more readily than the cracks in a thick size coat and therefore reduce the stress applied to the foam substrate in the region of the micro-cracks. That is, the micro-cracks in a thin size coat do not concentrate the stress to the point where the foam substrate will tear. In addition, it is believed that a thin size coat results in a greater number of micro-cracks which serve to distribute the stresses associated with cracking over a larger area, thereby further reducing the likelihood of tearing the foam substrate.

The dry add-on weight of the size coat which, upon cracking, will produce tears in the foam substrate depends to a certain degree on the size and amount of abrasive particles applied to the abrasive article. Accordingly, the dry add-on weight of the size coat will vary for different article configurations.

For most polymers, including phenolics, there exists a relationship between glass transition temperature and elongation. Generally, as the glass transition temperature of a polymer increases, elongation decreases and the polymer becomes more glass like. Fully cured size coats suitable for the present invention generally have a glass transition temperature of greater than 70° F. (21° C.) and, more specifically, greater than 122° F. (50° C.). Such size coats generally have a corresponding elongation of less than 10% or, more specifically, less than 5%. Accordingly, the flexibility of the cured size coat, measured in terms of its elongation, is less than the flexibility of the cured make coat. In addition, in accordance with the present invention, the Mohs hardness of the cured size coat is greater than the Mohs hardness of the cured make coat.

Size coat precursors suitable for use in the invention include coatable, hardenable adhesive binders and may comprise one or more thermoplastic or, preferably, thermosetting resinous adhesives. Resinous adhesives suitable for use in the present invention include phenolic resins, aminoplast resins having pendant α,β-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof. Catalysts and/or curing agents may be added to the binder precursor to initiate and/or accelerate the polymerization process.

Epoxy resins have an oxirane and are polymerized by the ring opening. Such epoxide resins include monomeric epoxy resins and polymeric epoxy resins. These resins can vary greatly in the nature of their backbones and substituent groups. For example, the backbone may be of any type normally associated with epoxy resins and substituent groups thereon can be any group free of an active hydrogen atom that is reactive with an oxirane ring at room temperature. Representative examples of acceptable substituent groups include halogens, ester groups, ether groups, sulfonate groups, siloxane groups, nitro groups and phosphate groups. Examples of some preferred epoxy resins include 2,2-bis[4-(2,3-epoxypropoxy)-phenyl)propane (diglycidyl ether of bisphenol a)] and commercially available materials under the trade designation "EPON 828", "EPON 1004" and "EPON 1001F" available from Shell Chemical Co., "DER-331", "DER-332" and "DER-334" available from Dow Chemical Co. Other suitable epoxy resins include glycidyl ethers of phenol formaldehyde novolac (e.g., "DEN-431" and "DEN-428") available from Dow Chemical Co.

Examples of ethylenically unsaturated binder precursors include aminoplast monomer or oligomer having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions or mixtures thereof.

The aminoplast binder precursors have at least one pendant alpha, beta-unsaturated carbonyl group per molecule or oligomer. These materials are further described in U.S. Pat. Nos. 4,903,440 (Larson et al.) and U.S. Pat. No. 5,236,472 (Kirk et al.), both incorporated herein by reference.

The ethylenically unsaturated monomers or oligomers may be monofunctional, difunctional, trifunctional or tetrafunctional or even higher functionality. The term acrylate includes both acrylates and substituted acrylates, such as methacrylates and ethacrylates. Ethylenically unsaturated binder precursors include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthyitol triacrylate, pentaerythritol trimethacrylate, pentaerythritol tetraacrylate and pentaerthyitol tetramethacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryl-oxyethyl) isocyanurate, 1,3,5-tri(2-methyacryloxyethyl)-s-triazine, acrylamide, methylacrylamide, N-methyl-acrylamide, N,N-dimethylacrylamide, N-vinyl-pyrrolidone, and N-vinyl-piperidone.

Isocyanurate derivatives having at least one pendant acrylate group and isocyanate derivatives having at least one pendant acrylate group are further described in U.S. Pat. No. 4,652,274 (Boettcher et al.), incorporated herein by reference. The preferred isocyanurate material is a triacrylate of tris(hydroxy ethyl) isocyanurate.

Acrylated urethanes are diacrylate esters of hydroxy terminated isocyanate extended polyesters or polyethers. Examples of commercially available acrylated urethanes include UVITHANE 782, available from Morton Thiokol Chemical, and CMD 6600, CMD 8400, and CMD 8805, available from UCB Radcure Specialties. Acrylated epoxies are diacrylate esters of epoxy resins, such as the diacrylate esters of bisphenol A epoxy resin. Examples of commercially available acrylated epoxies include CMD 3500, CMD 3600, and CMD 3700, available from UCB Radcure Specialties.

Examples of ethylenically unsaturated diluents or monomers can be found in U.S. Pat. No. 5,236,472 (Kirk et al.) which is incorporated herein by reference. In some instances these ethylenically unsaturated diluents are useful because they tend to be compatible with water.

Additional details concerning acrylate dispersions can be found in U.S. Pat. No. 5,378,252 (Follensbee), incorporated herein by reference.

It is also within the scope of this invention to use a partially polymerized ethylenically unsaturated monomer in the binder precursor. For example, an acrylate monomer can be partially polymerized and incorporated into the size coat precursor. The degree of partial polymerization should be controlled so that the resulting partially polymerized ethylenically unsaturated monomer does not have an excessively high viscosity so that the binder precursor is a coatable material. An example of an acrylate monomer that can be partially polymerized is isooctyl acrylate. It is also within the scope of this invention to use a combination of a partially polymerized ethylenically unsaturated monomer with another ethylenically unsaturated monomer and/or a condensation curable binder.

The adhesive materials used as the size coat precursor in the present invention can also comprise thermosetting phenolic resins such as resole and novolac resins, described in Kirk-Othmer, *Encyclopedia of Chemical Technology*, 3d Ed. John Wiley & Sons, 1981, New York, Vol. 17, pp. 384–399, incorporated herein by reference. Resole phenolic resins are made with an alkaline catalyst and a molar excess of formaldehyde, typically having a molar ratio of formaldehyde to phenol between 1.0:1.0 and 3.0:1.0. Novolac resins are prepared under acid catalysis and with a molar ratio of formaldehyde to phenol less than 1.0:1.0. A typical resole resin useful in the manufacture of articles of the present invention contains between about 0.75% (by weight) and about 1.4% free formaldehyde; between about 6% and about 8% free phenol; about 78% solids with the remainder being water. The pH of such a resin is about 8.5 and the viscosity is between about 2400 and about 2800 centipoise. Commercially available phenolic resins suitable for use in the present invention include those known under the trade designations "DUREZ" and "VARCUM", available from Occidental Chemicals Corporation (N. Tonawonda, N.Y.); "RESINOX", available from Monsanto Corporation; and "AROFENE" and "AROTAP", both available from Ashland Chemical Company; as well as the resole precondensate available under the trade designation "BB077" from Neste Resins, a Division of Neste Canada, Inc., Mississauga, Ontario, Canada. Organic solvent may be added to the phenolic resin as needed or desired.

Preferably, the size coat is foamed or frothed prior to its application to the foam substrate. The binder composition can be an aqueous dispersion of a binder that hardens upon drying. Most preferred among these binder compositions are foamable, coatable, hardenable resole phenolic resins comprising a surface active agent to assist in the formation of the foam and to enhance its stability. An exemplary commercially available surface active agent is that known under the trade designation "SULFOCHEM SLS" from Chemron Corporation of Paso Robles, Calif. Such foaming agents (emulsifiers) or surfactants are added to the size coat resin and are applied to the foam substrate using coating methods compatible with liquid coatings. Amounts nearing 1.0% to 6.0%, and preferably about 3% of the total wet components have been used.

Abrasive Particles

Useful abrasive particles suitable for inclusion in the abrasive articles of the present invention include all known fine and larger abrasive particles having a median particle diameter of from 1 micron to about 600 microns (2000 to 30 grit) with median particle diameters from about 10 microns to about 100 microns being preferred. Preferably, such fine abrasive particles are provided in a distribution of particle sizes with a median particle diameter of about 60 microns or less. Included among the various types of abrasive materials useful in the present invention are particles of aluminum oxide including ceramic aluminum oxide, heat-treated aluminum oxide and white-fused aluminum oxide; as well as silicon carbide, alumina zirconia, diamond, ceria, cubic boron nitride, garnet, ground glass, quartz, and combinations of the foregoing. Useful abrasive materials can also include softer, less aggressive materials such as thermosetting or thermoplastic polymers as well as crushed natural products such as nut shells, for example.

Those skilled in the art will appreciate that the selection of particle composition and particle size will depend on the contemplated end use of the finished abrasive article, taking into account the nature of the workpiece surface to be treated by the article and the abrasive effect desired. Preferably, the fine abrasive particles for inclusion in the articles of the invention comprise materials having a Moh's hardness of at least about 5, although softer particles may be suitable in some applications, and the invention is not to be construed as limited to particles having any particular hardness value. The particles are added to at least one of the first or second major surfaces of the foam substrate to provide a particle loading which is adequate for the contemplated end use of the finished article.

Additives

The make coat precursor or the size coat precursor or both can contain optional additives, such as fillers, fibers, lubricants, grinding aids, wetting agents, thickening agents, anti-loading agents, surfactants, pigments, dyes, coupling agents, photoinitiators, plasticizers, suspending agents, antistatic agents, and the like. Possible fillers include calcium carbonate, calcium oxide, calcium metasilicate, alumina trihydrate, cryolite, magnesia, kaolin, quartz, and glass. Fillers that can function as grinding aids include cryolite, potassium fluoroborate, feldspar, and sulfur. Fillers can be used in amounts up to about 400 parts, preferably from about 30 to about 150 parts, per 100 parts of the make or size coat precursor, while retaining good flexibility and toughness of the cured coat. The amounts of these materials are selected to provide the properties desired, as known to those skilled in the art.

Organic solvent and/or water may be added to the precursor compositions to alter viscosity. The selection of the particular organic solvent and/or water is believed to be within the skill of those practicing in the field and depends upon the thermosetting resin utilized in the binder precursor and the amounts of these resins utilized.

Method

Figure 4:
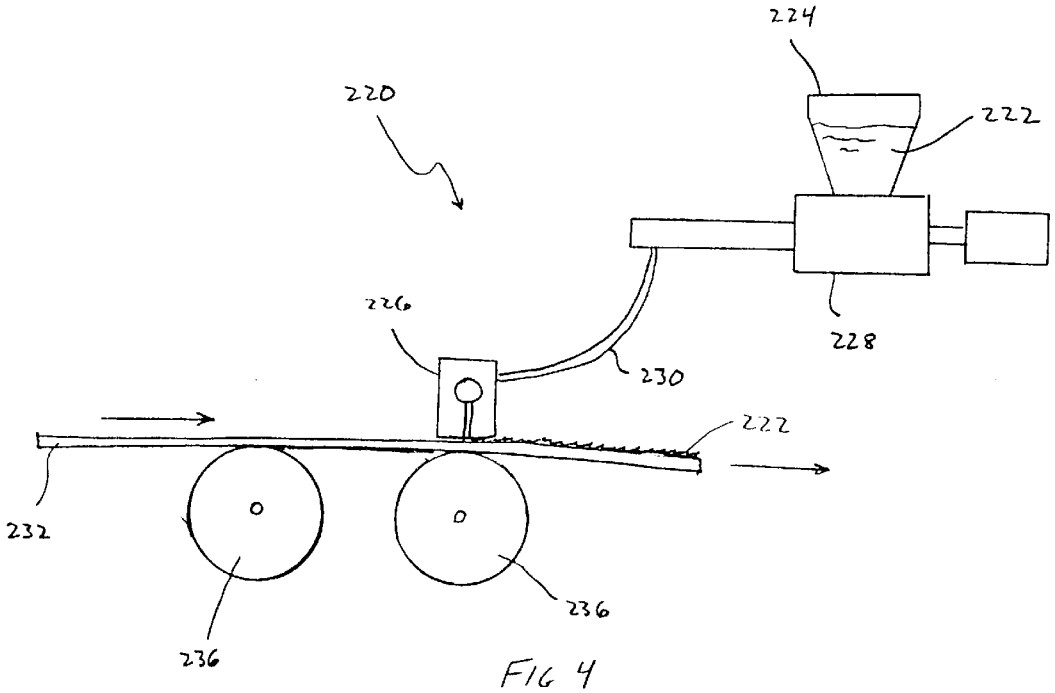
FIG. 4 is a diagrammatic illustration of a make coat applying apparatus.
Figure 5:
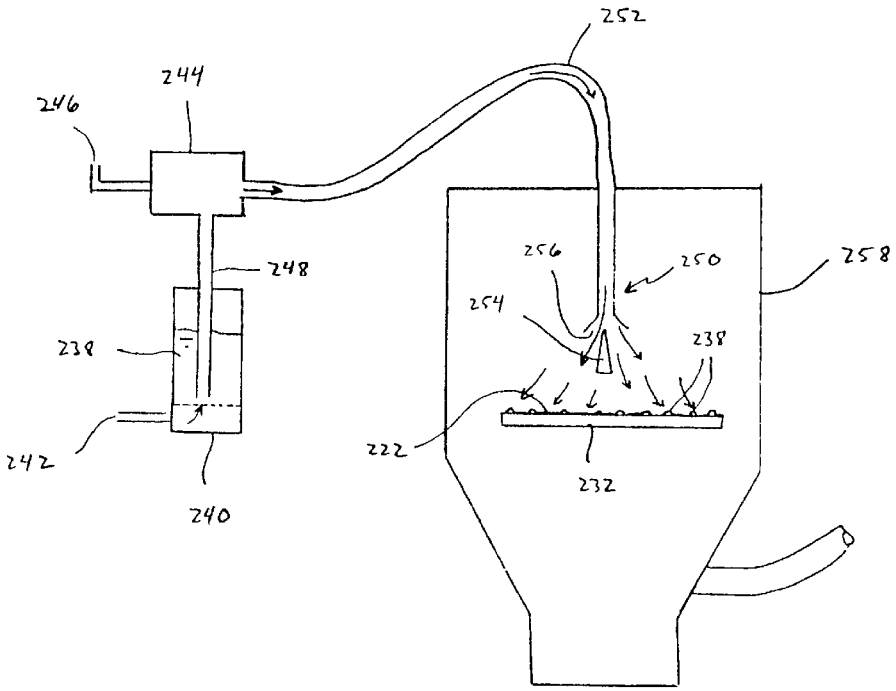
FIG. 5 is a diagrammatic illustration of a particle applicator.
Figure 6:
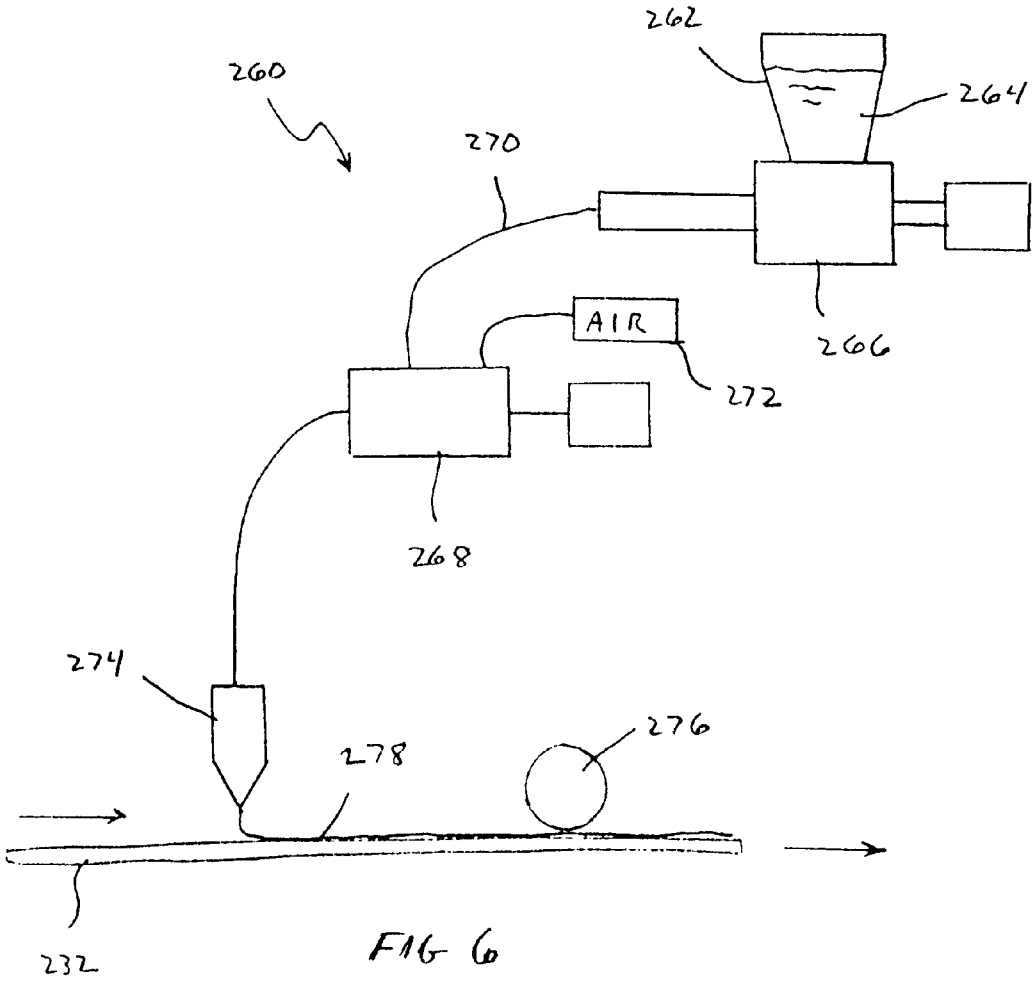
FIG. 6 is a diagrammatic illustration of a size coat applying apparatus.

The resilient abrasive article of FIG. 1 is formed by applying a make coat precursor to the foam substrate 4, applying abrasive particles 10 to the make coat 8, applying a size coat precursor over the abrasive particles and the make coat, and appropriately curing the article. A specific method of making the article of FIG. 1 is shown in FIGS. 4–6. While the method is described specifically for making the article shown in FIG. 1, it will be recognized that a method similar to that described can be used to produce the articles shown in FIGS. 3 and 4.

Referring to FIG. 4, there is shown an apparatus 220 for applying a make coat to a foam substrate. A make coat precursor resin 222 is loaded into a resin hopper 224. From the resin hopper 224, the precursor resin 222 is pumped to a fluid bearing die 226 via pump 228 and resin hose 230. The fluid bearing die 226 applies the make coat precursor resin 222 to the moving foam substrate 232 which is conveyed on a pair of rollers 236 to form the make coat. Alternatively, the make coat precursor can be applied using a suitable coater known in the art, such as a spray coater, roll coater, dip coater, knife over roll coater, or the like.

Next, abrasive particles are applied using the apparatus of FIG. 5. The apparatus can be the same as that described in U.S. Pat. No. 5,849,051 (Beardsley et al.), which is assigned to the same assignee as the present invention and is hereby incorporated by reference. Abrasive particles 238 are fluidized in a fluidizing bed 240 using fluidizing air introduced into the bed via air inlet 242. A venturi pump 244 receives air from a suitable source (not shown) via air inlet 246 and draws the mixture of fluidized particles and air through draw tube 248. The mixture of particles 238 and air is delivered to the particle sprayer 250 via particle hose 252. The particle sprayer includes a deflector 254 mounted at the exit 256 which serves to redirect the flow of the fluidized abrasive particle/air mixture so that the mixture is not sprayed directly onto the foam substrate 232. Instead, the desired uniform distribution of abrasive particles 238 is achieved by creating a uniformly dispersed cloud of abrasive particles above the foam substrate 232 having the liquid make coat precursor 222 thereon. The cloud then deposits, preferably by settling due to gravity, onto the foam substrate in the desired uniform pattern. The abrasive particles 238 are applied to the foam substrate 232 in a particle spray booth 258 which serves to contain, collect, and recycle the excess abrasive particles. The foam substrate 232 enters and exits the spray booth 258 through slots (not shown) contained in the front and back of the spray booth, and is conveyed through the booth by rollers similar to those shown in FIG. 4. Other known techniques for applying abrasive particles, such as drop coating or electrostatic coating, can also be used. After the abrasive particles have been applied to the foam substrate, the make coat can be cured using a suitable technique known in the art.

The size coat is then applied over the make coat 222 and abrasive particles 238 using the apparatus shown in FIG. 6. The size coat applying apparatus 260 includes a resin hopper 262 that feeds the size coat precursor 264 into a pump 266. The size coat precursor 264 is pumped to a frother 268 via hose 270. In the frother, the size coat precursor is frothed with air provided by a compressed air source 272 to form a labile foam. Frothing the size coat precursor allows a thin size coat characterized by a low dry add-on weight to be formed on the foam substrate. When a sufficiently thin size coat is produced on the foam substrate, the size coat can crack without tearing the foam substrate. It has been found that a size coat having a dry add-on weight of less than 15 grains/24 $in^2$ (63 grams/$m^2$) can crack without tearing the foam substrate. The frothed size coat precursor 264 is then applied over the abrasive particles 238 and make coat 222 using a froth die 274. An idler roller 276 is provided to control the application of the frothed size coat precursor 278. One suitable frother is of the type commercially available as a "F2S-8" from SKG Industries, West Lawn, Pa. Other known methods can also be used to apply the frothed size coat resin to the foam substrate. In addition, a sufficiently thin size coat can be produced by diluting the size coat precursor and spraying the size coat precursor directly onto the foam substrate. Once the size coat has been applied, the make and size coats are fully cured to securely affix the abrasive particles to the substrate.

EXAMPLE

The following materials were used to make a resilient abrasive article according to the present invention:

Foam Substrate: urethane sponge

Make Coat: acrylic

Abrasive Particles: $Al_2O_3$

Size Coat: phenolic resin

The article was prepared by conveying the foam substrate through each apparatus at a velocity of approximately 6 ft/min. The foam substrate was a green carpet underpadding foam available from the Woodbridge Foam Corporation, Mississauga, Ontario, Canada. The foam substrate was 0.197 inches (5 mm) thick and 12 inches wide (30.48 cm), had a density of 3.0 lbs/$ft^3$ (48.1 kg/$m^3$), and an elongation of approximately 90%.

The make coat composition included the following:

| Material | % Solids | Amount (grams) |
|---|---|---|
| HYCAR 2679 | 49.9% | 7214 |
| Water | 0% | 566 |
| EZ-1 solution | 5% | 160 |
| Ammonium Hydroxide | 35% | 24 |

HYCAR 2679 is an acrylic emulsion available from BF Goodrich, Cleveland, Ohio which can have an elongation of 366–630%, depending on how it is cured. The water serves as a diluent, the EZ-1 solution is a polyacrylic acid also available from BF Goodrich which serves as a thickener, and the ammonium hydroxide serves as an activator for the EZ-1 solution. The make coat precursor was applied to the foam substrate using, a slot die over a roller fed by a Moyno progressing cavity pump available from Moyno Industrial Products, Springfield, Ohio. The resulting make coat had a dry add-on weight of 28 grains/24 $in^2$ (117.6 grams/$m^2$).

Aluminum Oxide ($Al_2O_3$) abrasive particles were then applied to the make coat using the method described above to apply a 120 abrasive grit. The dry add-on weight of the abrasive particles was 22 grains/24 $in^2$. After application of the abrasive particles, the make coat was then cured for 4 minutes at 300° F. (149° C.). The size coat was then applied over the make coat and abrasive particles.

The size coat was BBO77 phenolic resin available from Neste Resins Canada, a Division of Neste Canada Inc., Mississauga, Ontario, Canada. The phenolic resin size coat precursor also included Sulfochem SLS surfactant available from Chemron Corporation, Paso Robles, Calif.; 46% nitrogen prilled industrial grade urea available from BP Chemicals, Gardena, Calif.; AMP 95—a 2 amino 2 methyl 1 propanol, 95% aqueous solution available from Ashland Chemical, Co., Dublin, Ohio; and water. The phenolic resin had an overall solids content of approximately 70%. The size coat precursor was frothed to a blow ratio of 8:1 (i.e., the ratio of frothed volume to that of the unfrothed starting material). The mixer was operated at approximately 330 RPM and the air flow rate was approximately 1.2 liters/min. The size coat precursor resin was fed using a Moyno progressing cavity pump, and the frothed size coat resin was applied by rolling an idler roller on the foam substrate. The size coat was then cured for 4 minutes at 300° F. (149° C.). The resulting size coat had a dry add-on weight of 6 grains/24 $in^2$ and an elongation of less than 10%.

It will be apparent to those of ordinary skill in the art that various changes and modifications may be made without deviating from the inventive concept set forth above. Thus, the scope of the present invention should not be limited to the structures described in this application, but only by the structures described by the language of the claims and the equivalents of those structures.

What is claimed is:

1. A resilient abrasive article, comprising:

(a) a resilient substrate having an outer surface, said substrate having an elongation in the range of 50–200%;

(b) an adhesive make coat on at least a portion of said outer surface, said make coat having an elongation greater than said substrate elongation;

(c) abrasive particles each having a portion embedded within said make coat; and (d) an anti-loading size coat arranged over said make coat and said abrasive particles, said size coat having an elongation less than said make coat elongation.

2. A resilient abrasive article as defined in claim 1, wherein said resilient substrate is formed of a foam material having a thickness of at least 3 millimeters.

3. A resilient abrasive article as defined in claim 1, and further comprising a flexible intermediate size coat arranged between said make coat and said anti-loading size coat, said intermediate size coat having a flexibility greater than said anti-loading size coating.

4. A resilient abrasive article as defined in claim 2, and further comprising a barrier layer adjacent to said foam substrate.

5. A resilient abrasive article as defined in claim 2, wherein said foam substrate is formed of a material selected from the group consisting of polyurethane, foam rubber, silicone, and natural sponge.

6. A resilient abrasive article as defined in claim 1, wherein said make coat is selected from the group consisting of nitrile rubber, acrylate, epoxy, urethane, polyvinyl chloride, and butadiene rubber.

7. A resilient abrasive article as defined in claim 1, wherein said abrasive particles comprise material selected from the group consisting of aluminum oxide, silicon carbide, alumina zirconia, diamond, ceria, cubic boron nitride, garnet, ground glass, quartz, and combinations thereof.

8. A resilient abrasive article as defined in claim 1, wherein said size coat is a coatable, hardenable resinous adhesive binder.

9. A resilient abrasive article as defined in claim 1, wherein said size coat is selected from the group consisting of phenolic resins, aminoplast resins having pendant α,β-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof.

10. A hand-held sanding sponge for sanding contoured work surfaces, comprising:

(a) a resilient flexible foam substrate having a top surface, a bottom surface, opposite side surfaces, and opposite end surfaces, said substrate having a thickness of at least 3 millimeters and an elongation in the range of 50–200%;

(b) an adhesive make coat on at least a portion of each of said top and bottom surfaces, said make coat having an elongation greater than said foam substrate elongation and further having a dry add-on weight in the range of 15–50 grains/24 $in^2$;

(c) abrasive particles each having a portion embedded within said make coat; and (d) a size coat arranged over said make coat and said abrasive particles, said size coat having an elongation of less than 10% and a dry add-on weight of less than 15 grains/24 $in^2$;

wherein said sanding sponge is capable of conforming to the contoured work surface and the size coat is able to crack without tearing the foam substrate.

11. A hand-held sand sponge as defined in claim 10, wherein said foam substrate is formed of a material selected from the group consisting of polyurethane, foam rubber, silicone, and natural sponge.

12. A hand-held sanding sponge as defined in claim 11, wherein said make coat is selected from the group consisting of nitrile rubber, acrylate, epoxy, urethane, polyvinyl chloride, and butadiene rubber.

13. A hand-held sanding sponge as defined in claim 12, wherein said abrasive particles comprise material selected from the group consisting of aluminum oxide, silicon carbide, alumina zirconia, diamond, ceria, cubic boron nitride, garnet, ground glass, quartz, and combinations thereof.

14. A hand-held sanding sponge as defined in claim 13, wherein said size coat is a coatable, hardenable resinous adhesive binder.

15. A hand-held sanding sponge as defined in claim 14, wherein said size coat is selected from the group consisting of phenolic resins, aminoplast resins having pendant (α,β-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof.

* * * * *